United States Patent [19]

Reinehr et al.

[11] Patent Number: 4,457,884

[45] Date of Patent: Jul. 3, 1984

[54] CONTINUOUS DRY-SPINNING PROCESS FOR ACRYLONITRILE FILAMENTS AND FIBRES

[75] Inventors: Ulrich Reinehr, Dormagen; Hans Uhlemann, Solingen, both of Fed. Rep. of Germany

[73] Assignee: Bayer Aktiengesellschaft, Leverkusen, Fed. Rep. of Germany

[21] Appl. No.: 505,544

[22] Filed: Jun. 17, 1983

[30] Foreign Application Priority Data

Jul. 6, 1982 [DE] Fed. Rep. of Germany ..... 3225266

[51] Int. Cl.[3] ..... D01D 5/22

[52] U.S. Cl. ..... 264/168; 264/206; 264/210.3; 264/210.8

[58] Field of Search ..... 264/206, 168, 210.3, 264/210.8

[56] References Cited

U.S. PATENT DOCUMENTS

| | | | |
|---|---|---|---|
| 2,811,409 | 10/1957 | Clapp et al. | 264/206 |
| 2,988,419 | 6/1961 | Walter | 264/206 |
| 3,124,631 | 3/1964 | Davis et al. | 264/206 |
| 3,932,571 | 1/1976 | Dworjanin | 264/206 |
| 3,944,386 | 3/1976 | Wilkinson | 264/206 |
| 4,011,294 | 3/1977 | Davis | 264/206 |

*Primary Examiner*—Jay H. Woo
*Attorney, Agent, or Firm*—Sprung, Horn, Kramer & Woods

[57] ABSTRACT

Ready-for-despatch filaments and fibres made of acrylonitrile polymers which contain at least 40% by weight of acrylonitrile units can be prepared from a spinning solution in a continuous dry-spinning method in which (a) the spinning solution spun has a viscosity at 100° C. of 10 to 60 falling-ball seconds, (b) the evaporation of the solvent in the spinning cell is controlled in such a way that on leaving the spinning cell the solvent content of the filaments is at most 40% by weight, relative to the solids content of the fibre, (c) before the stretch the filaments are treated with a spin-finish which contains a lubricant and an antistat and gives the filaments a moisture content of at most 10% by weight, relative to the solids content of the fibre, and (d) before the stretch the filaments have no contact with any other extraction liquid for the spinning solvent.

9 Claims, No Drawings

CONTINUOUS DRY-SPINNING PROCESS FOR ACRYLONITRILE FILAMENTS AND FIBRES

The invention relates to a continuous process for preparing crimped filaments and fibres made of acrylonitrile polymers which contain at least 40% by weight of acrylonitrile units. For the purposes of the invention, a continuous process is a process in which in one uninterrupted operation the filaments are dry-spun, stretched, crimped, shrunk, heat-set and, if desired, cut to give stable fibres.

Acrylic fibres are usually prepared by wet-, dry- or melt-spinning. While such continuous processes as are free of tow weight limits have already been disclosed for the wet- or melt-spinning of acrylic fibres, for example the wet-spinning process of Textiltechnik 26 (1976), pages 479–483, or the melt-extrusion process of German Offenlegungsschrift No. 2,627,457, only one continuous process for dry-spinning acrylic fibres has hitherto been disclosed, and this process can only be used for low tow weight multifilament yarns, so-called acrylic silk and is subject to certain conditions (U.S. Pat. No. 2,811,409). This process cannot be used for preparing high-weight acrylic tows.

The two processes which are used today on a large scale, namely the wet-spinning process and the dry-spinning process, have developed in time in two different directions. In wet-spinning, where the spinning solution is spun into a coagulation bath and coagulated there to give filaments which are then without interruption washed, stretched, dried and spin-finished, spinning jets having a large number of holes, about 10,000, are used. At 5 to 20 m/min, the spin speed is relatively low. Because of the danger of the filaments sticking to one another in the several meters long spinning cell, dry-spinning can only be carried out with spinning jets having a relatively small number of holes, normally about 200 to 1,000, but significantly higher take-off speeds are possible, usually between 200 and 1,000 m/min, so that dry-spinning achieves in principle production outputs similar to those in wet-spinning. However, because of the high spinning speeds the overall dry-spinning process cannot be carried out in a continuous manner with high tow weights, since the stretching ratio of about 1:4 would result in terminal speeds which, technically, can only be handled with difficulty if at all. For this reason the dry-spinning process is interrupted before the stretch and the spun material is collected in cans from which it is then fed into further processing (Bela von Falkai, Synthesefasern (Synthetic fibres), Verlag Chemie, Weinheim/Deerfield Beach, Florida/Basel (1981), pages 204–206; and R. Wiedermann, Acrylic fibre spinning and aftertreatment processes in Chemiefasern-/Textilindustrie, June 1981, pages 481–484, in particular at the top of the left-hand column on page 482).

Since it is economically and ecologically as well as for the uniformity of the spun material disadvantageous to run the spun material into cans, it is an object of the present invention to provide a continuous process for preparing acrylic fibres by dry-spinning, in which all stages, from filament formation to the ready-for-despatch fibre, take place in one operation without any interruption or intermediate storage and which can be applied to high-weight tows. It should preferably be possible to incorporate the preparation of the spinning solution in the continuous process.

It has been found, surprisingly, that this object can be achieved if a spinning solution of a certain viscosity is used, the solvent content in the spun material is reduced in the spinning cell by a solvent removal method to below certain values, the filaments are treated before the stretch with a spin-finish which contains a lubricant and an antistat, and preferably is an aqueous formulation, but the water absorption (moisture) of the filaments remains below certain values, and the filaments have no contact before the stretch with any other solvent-extracting liquid.

The invention therefore relates to a process for preparing filaments and fibres made of acrylonitrile polymers which contain at least 40% by weight of acrylonitrile units by spinning a spinning solution of the polymer into a spinning cell, evaporating at least some of the spinning solvent in the spinning cell, spin-finishing, stretching, crimping, heat-setting and, if desired, cutting in a continuous operation, characterised in that (a) the spinning solution spun has a viscosity at 100° C. of 10 to 60 falling-ball seconds, (b) the evaporation of the solvent in the spinning cell is controlled in such a way that on leaving the spinning cell the solvent content of the filaments is at most 40% by weight, relative to the solids content of the fibre, (c) before the stretch the filaments are treated with a spin-finish which contains a lubricant and an antistat and gives the filaments a moisture content of at most 10% by weight, relative to the solids content of the fibre, and (d) before the stretch the filaments have no contact with any other extraction liquid for the spinning solvent.

The draw-down of the process is preferably greater than 2, in particular between 2 and 12. In a particularly preferred embodiment, the spinning solution has at 100° C. a viscosity of 15 to 50 falling-ball seconds, on leaving the spinning cell the solvent content of the filaments is at most 20% by weight, in particular at most 10% by weight, relative to the solids content of the fibre, and the tow temperature during stretching is 100° to 180° C. Throughout the entire process the filaments preferably do not come into contact with any other extraction liquid. The stretch ratios are in particular between 2 and 12, the preferred range being from 3 to 6 for copolymers and from 5 to 12 for homopolymers.

The draw-down V is defined as the ratio of the take-off speed A to the extrusion speed S:

$$V = \frac{A\ (\mathrm{m/min})}{S\ (\mathrm{m/min})}$$

The extrusion speed S is given by:

$$S = \frac{4 \times F}{Z \times d^2 \times \pi \times 100} \text{ where}$$

where

F = delivery rate ($cm^3$/min)

Z = number of holes per spinning jet d = jet hole diameter (cm)

The delivery rate (pump volume times number of revolutions per minute) is given by the following equation:

$$G_{ST} = \frac{P \times U \times K \times 0.94 \times 10000}{A \times 100} \text{ where}$$

where $G_{ST}$=total linear density (dtex=g/10,000 m)

P=pump volume ($cm^3$)

U=number of revolutions per minute ($min^{-1}$)

K=spinning solution concentration ($g/cm^3$)

A=take-off speed (m/min)

The process of the invention makes it possible to produce 100,000 or more dtex tows which contain so little residual solvent that, after a hot stretch and a subsequent crimping and shrinking process, the residual solvent content in the finished fibre or tow is markedly below 1% by weight without the spun material coming into contact with an extracting agent for the spinning solvent apart from the water content of the spin-finish. The filaments obtained in the invention have fibre tenacities of greater than 2 cN/dtex.

Suitable for use as acrylonitrile polymers are all acrylonitrile homopolymers and copolymers which can be spun into so-called acrylic fibres or modacrylic fibres, preferably acrylonitrile copolymers containing at least 85% by weight of acrylonitrile units. Homopolymers and terpolymers consisting of 89 to 95% by weight of acrylonitrile, 4 to 10% by weight of a nonionic comonomer and 0.5 to 3% by weight of an ionic comonomer are particularly preferred, preferred comonomers being, on the one hand, methyl acrylate, methyl methacrylate and vinyl acetate and, on the other, methallyl sulphonate and styrene sulphonte. The polymers are known.

The process of the invention differs from the process of U.S. Pat. No. 2,811,409 by the different viscosity of the spinning solution, which, in the earlier patent should not be less than 400 poise at 100° C., which corresponds to 91 falling-ball seconds at 100° C., individual examples going as low as 300 poise, which corresponds to 69 falling-ball seconds, and by the draw-down which is chiefly between 0.5 and 1.5. Examples featuring higher draw-downs have extremely high viscosities. As mentioned, the process is restricted to very low tow rates, and requires a complicated spinning cell.

Although the invention can also be carried out with low draw-downs, the economic benefit is realised precisely when, in contrast to the prior art, high draw-downs of 10 and more are possible. The process of the invention is preferably carried out with a spinning cell into which the hot air used to evaporate the spinning solvent is blown at the head of the spinning cell, at most 50 cm below the spinning jet, along or across the filaments.

An essential feature of the process according to the invention is that as the spun material, that is to say, the tow, leaves the spinning cell it has a residual solvent content of less than 40% by weight, in particular between 2 and 10% by weight, relative to the dry weight of the fibre, since spun material containing more than 40% by weight of residual solvent, for example dimethylformamide, becomes tacky at tow temperatures from about 120° C. during the subsequent hot stretch over godets. If, to avoid this tackiness, tow temperatures of below 100° C. are used, an undesirable cold elongation of the material takes place, that is to say a non-uniform and incomplete stretch under poorly defined conditions where the degree of stretch is limited to at most 3:1. In contrast, spun material containing less than 40% by weight of residual solvent can be stretched over godets or in a steaming zone without tackiness or break at tow temperatures of up to 180° C., but it is necessary to carry out this hot stretch immediately after the spun material has been wetted while still hot, preferably at the end of the spinning cell, either inside it or immediately thereafter, with a spin-finish which contains a lubricant and an antistat, and without allowing the hot spun material to cool down. The lubricant permits satisfactory stretching of even thick tows, of 100,000 dtex or more. The finish can also contain water as a component, but care should be taken to ensure that the tow does not absorb more than 10% by weight of moisture. If the tow has a higher water content, it cools down too much and unevenly, and the subsequent hot stretch, despite high stretching temperatures of 200° C. or more, no longer gives satisfactory stretching. The tow shows broken filaments or forms wraps round the godets.

Examples of suitable lubricants are glycols, their derivatives, silicone oils, ethoxylated fatty acids, alcohols, esters, amides and alkyl ether sulphates, and mixtures thereof. The finish can contain as antistat a suitable commercially available product, for example a conventional cationic, anionic or non-ionic compound, such as a long-chain ethoxylated, sulphated and neutralised alcohol. The finish advantageously has a temperature of 50°-90° C. to prevent the hot sheet of filaments from cooling down. The individual tows spun in a machine which has, for example, 20 spinning cells and which have a total linear density of 100,000 dtex or more are treated with finish in this way and combined into one tow, which is passed over a take-off element to a pair of rolls which can be inductively heated to over 200° C. The tow is wound one or more times around the pair of rolls, if appropriate by means of a secondary roll, thereby establishing one clamping point. The second clamping point takes the form of a coolable take-off quintet or septet which is mounted about 3 m away from the inductively heated pair of rolls and which stretches the tow by virtue of its speed which has been set at an appropriately higher value. It is necessary to cool the rolls in the secondary stretching element to avoid, in the subsequent crimping process, caked-together filaments and tow stiffness, which phenomena are observed in acrylic fibres at temperatures of above about 130°-140° C. The spinning solvent residues which escape in the course of the hot stretch are sucked away and recovered via a cooling system. The preferred stretching elements have been found to be septet rolls which can be heated at one end and can be cooled at the other end. It is advantageous to aid uniform performance of the stretching process, in particular in the case of high tow weights, by integrating between the septet rolls a tube which is heated with superheated steam or hot air.

Spinning take-off speeds of 50-100 m/min are generally sufficient to keep the residual solvent content in the spun material clearly below 10% by weight, so that, with a 300-1,000% degree of stretch, technically manageable terminal speeds of 150 to 1,000 m/min are obtained.

In a further embodiment of the invention, the tow is then, depending on its speed, crimped in a stuffer box or, at speeds above 300-400 m/min, passed to a high-performance texturising spinning jet in which it is crimped, preferably by means of superheated steam at at least 105° C. In the further course of the continuous process, the crimped tow has its shrinkage potential removed by being relaxed with saturated or superheated steam or in dry heat, for example over a sieve belt or U-shaped steaming tube. The fully shrunk tow is then, as required, packed into cartons or cut into staple fibres which are compressed into bales. The process is particularly suitable for preparing spun-dyed filaments and fibres through the addition of soluble dyestuffs, in particular cationic dyestuffs, or pigments to the spinning solution, since, in the method of processing, a change in colour leads to significantly less reject material being produced.

Also, the preparation of the solution can be easily integrated into the continuous process, whether they be conventional ways of preparing the solution or, in particular, the following method:

First, a suspension is prepared at room temperature from the spinning solvent, the polymer and, if appropriate, such a non-solvent for the polymer as is miscible with the spinning solvent, for example water in an amount of 2 to 20 g per 100 g of polymer. This suspension is heated to a temperature which is at least 30 ° and at most 60° C. above those temperatures at which the suspension becomes optically homogeneous, that is turns into a solution, is held at this temperature for 1 to 15 minutes, and is then immediately passed to the spinning stage.

In a further embodiment of the invention, the spinning solution preparation stage is preceded by a solution polymerisation in the spinning solvent used, for example dimethylformamide, so that, after the solution has been suitably concentrated and has had its monomer removed via a thin-film evaporator, for the first time a highly automated continuous process has been achieved for dry-spinning acrylic fibres.

The process of the invention is also suitable for the continuous preparation of bicomponent filaments and fibres, where the aftertreatment steps are suitably modified in line with known bicomponent filament technology.

The viscosity in falling-ball seconds, measured at 100° C., was determined in accordance with the method of K. Jost, Reologica Acta, volume 1 (1958), page 303. The following conversion rule applies: 1 falling-ball second equals 4.37 poise.

All temperatures measured in the course of the continuous acrylic fibre production process from the spinning machine onwards were measured in a contact-free manner with a KT 15 radiation thermometer (manufacturer: Heimann GmbH, Wiesbaden, West Germany).

EXAMPLE 1

700 kg of dimethylformamide (DMF) are mixed in a vessel at room temperature with stirring with 300 kg of an acrylonitrile copolymer which consists of 93.6% of acrylonitrile, 5.7% of methyl acrylate and 0.7% of sodium methallyl sulphonate and which has a K value of 81. The suspension is pumped by a gear pump into a spinning vessel which is equipped with a stirrer. The suspension is then heated in a jacketed pipe with steam at 4.0 bar. The dwell time in the pipe is 5 minutes. The spinning solution, which at the pipe outlet has a temperature of 138° C. and a viscosity of 19 falling-ball seconds, measured at 100° C., is cooled down to 90° C. on leaving the heating-up apparatus, filtered and directly passed into a spinning unit which has 20 spinning cells.

The spinning solution is dry-spun through a spinning jet which has 1,264 0.2 mm diameter holes, with a take-off speed of 50 m/min and a draw-down of 7.2. The dwell time of the filaments in the spinning cells is 5 seconds. The spinning cell temperature is 200° C., and the air temperature is 350° C. Air is blown into each cell with a rate of 40 $m^3/h$ at the head of the cell in longitudinal direction to the filaments.

The spun material, which has an overall linear density of 310,000 dtex and a residual solvent content of 11.1% by weight, relative to the solids content, is immediately wetted, on leaving the spinning cells, with a warm, aqueous, oil-containing, antistatic finish at 80°–90° C. in such a way that the oil content of the filaments is 0.16% by weight, the antistat content is 0.04% by weight and the moisture content is 1.1% by weight, relative to the solids content of the fibre. The spin-finish is metered out via gear pumps. The warm tow is then passed over an inductively heated pair of rolls at 200° C., a contact time of about 2 seconds being obtained by winding the tow several times around a secondary roll, and the tow being raised to a temperature of 156° C., measured with a KT 15 radiation thermometer. The tow is stretched by 500%, the second clamping point comprising a stretching septet having coolable rolls. The tow temperature after the stretch is 80° C. Immediately thereafter, the tow is crimped in a stuffer box, and relaxed in a tube which is supplied with saturated steam. The dwell time in the steaming tube is about 4 minutes. The fully shrunk tow is then cut into 60 mm staple fibres, which are blown to a packing press. The acrylic fibres thus prepared in a continuous process have a final individual fibre linear density of 3.3 dtex. The fibre tenacity is 3.4 cN/dtex, and the elongation at break is 48%. The fibres are completely free of voids, and have a density of 1.181 $g/cm^3$ and a completely smooth, texture-free surface. Yarns prepared therefrom at 140 m/min on a high-performance carding machine have a breaking length of 17.5 km, an elongation at break of 19.4% and a boil shrinkage of 2.2%.

Table I, below, shows the running properties of spun materials which have the same total linear density of 310,000 dtex but differ in DMF content, degree of stretch and tow temperature. The different DMF contents in the spun material were produced by varying the cell and air temperatures, the air supply rate and the dwell time in the spinning cell. As can be seen from the table, residual solvent contents in the spun material of above about 40% by weight no longer give reasonable running properties or adequate fibre tenacities. The spun material is caked together or can only be cold-stretched.

Table II, below, shows under what spinning and aftertreatment conditions filaments were produced from various spinning solution concentrations of an acrylonitrile copolymer of the composition of Example 1 and of a K value of 81 and the resulting fibre tenacities and elongations at break. In each case, the same total linear density of 310,000 dtex was set for the various concentrations by varying the delivery rate of the spinning pump. Otherwise the spinning and aftertreatment parameters are the same as those in Example 1. The viscosities of the spinning solutions, measured in falling-ball seconds, were again determined at 100° C. Those skilled in the art know that, depending on the K value of the polymers, the concentrations of spinning solutions can also be affected by methods other than those specified in Table II. For instance, the lower the K value, the higher is the spinning solution concentration which can be spun into filaments, and vice versa.

However, the crucial factor in filament formation is in each case the viscosity. This is where the Table II limiting values for the spinning of acrylonitrile polymer spinning solutions into filaments were determined.

TABLE I

| No. | % age DMF content in the spun material | % age moisture content in the spun material | Tow temperature in °C. | Degree of stretch | Tenacity in cN/dtex | % age elongation at break | Comments |
|---|---|---|---|---|---|---|---|
| 1 | 11,1 | 1,9 | 68 | 1:2,5 | — | — | Breakages |
| 2 | 11,1 | 1,9 | 72 | 1:2,5 | 1,6 | 80 | |
| 3 | 11,1 | 1,9 | 86 | 1:5 | — | — | Breakages |
| 4 | 11,1 | 1,9 | 120 | 1:5 | 2,9 | 54 | |
| 5 | 22,3 | 1,1 | 120 | 1:5 | 2,6 | 64 | |
| 6 | 37,6 | 2,1 | 69 | 1:2,5 | 1,2 | 161 | |
| 7 | 43,5 | 1,5 | 71 | 1:5 | — | — | Breakages |
| 8 | 43,5 | 1,5 | 71 | 1:2,5 | 0,8 | 179 | Cold stretch |
| 9 | 43,5 | 1,5 | 120 | 1:5 | — | — | Caking |

TABLE II

| No. | % age spinning solution concentration | Falling-ball seconds | % age DMF content in the spun material | Tenacity in cN/dtex | % age elongation at break | Comments* |
|---|---|---|---|---|---|---|
| 1 | 24 | 4,8 | 13,9 | — | — | unspinnable, no solidification into filaments satisfactory running |
| 2 | 26 | 9,6 | 12,8 | 3,1 | 56 | good running |
| 3 | 28 | 15,7 | 12,4 | 3,2 | 53 | good running |
| 4 | 30 | 19,0 | 11,1 | 3,4 | 48 | good running |
| 5 | 32 | 36,2 | 10,9 | 3,2 | 52 | good running |
| 6 | 34 | 51,1 | 10,7 | 3,3 | 50 | individual breakages |
| 7 | 36 | 70,4 | 9,9 | 3,4 | 46 | individual breakages |
| 8 | 37 | 90,3 | 8,8 | 3,1 | 54 | |
| 9 | 37,5 | 130,2 | 8,6 | — | — | spinning solution no longer preparable, since too viscous |

*good running: runs without problems, filament breakages, slips or wraps
satisfactory running: occasional individual filament break and tendency to form wraps

EXAMPLE 2

An Example 1 spinning solution is dry-spun through 380-hole spinning jets, hole diameter 0.2 mm, with a take-off speed of 166.6 m/min and a draw-down of 5.7. The dwell time of the filaments in the spinning cells is 1.5 seconds. The cell temperature is 160° C., the air temperature is 300° C., and air is blown through each cell at 40 $m^3/h$. The viscosity of the spinning solution is again 19 falling-ball seconds, measured at 100° C. The filaments, whcih have a total linear density of 118,000 dtex and still have a residual solvent (DMF) content of 39.4% by weight, are aprayed on the inside of the bottom spinning cell seals with a warm aqueous oil-containing antistatic spin-finish at 80°–90° C. The oil content of the filaments is 0.18% by weight, the antistat content is 0.04% by weight, and the moisture content is 1.9% by weight, relative to the solids content, The warm tow is then reheated in the manner described in Example 1, is stretched 3.6-fold with a tow temperature of 133° C., is cooled down over septet rolls, is crimped with a tow temperature of 66° C., and is relaxed in a tube containing saturated steam. The fully shrunk tow is then cut into 60 mm staple fibres, which are blown into a packing press. The acrylic fibres thus prepared in a continuous process have a final individual fibre linear density of 5.0 dtex. The tenacity is 2.1 cN/dtex, and the elongation at break is 39%. The density is 1.182 $g/cm^3$. The fibre surface is completely smooth and free of grooves. Yarns prepared from the fibres on a high-performance carding machine at 130 m/min have a breaking length of 12.2 km, an elongation at break of 19.4% and a boil shrinkage of 3.0%.

EXAMPLE 3

An Example 1 spinning solution is dry-spun through 1,264-hole spinning jets, hole diameter 0.2 mm, with a take-off speed of 125 m/min and a draw-down of 6.3. The dwell time of the filaments in the spinning cells is 2 seconds. The cell temperature is 200° C., and the air temperature is 350° C. The air is blown through each cell at 40 $m^3/h$. The viscosity of the spinning solution is again 19 falling-ball seconds, measured at 100° C. The spun material, which has a total linear density of 356,000 dtex and which still contains a residual solvent (DMF) content of 24.1% by weight, is sprayed at the end of the spinning cell with a warm aqueous oil-containing antistatic spin-finish at 80°–90° C. in such a way that the oil content of the filaments is 0.15% by weight, the antistat content is 0.04% by weight and the moisture content is 2.1% by weight, relative to the solids content. The tow is then reheated over septet rolls to a tow temperature of 145° C., and treated in a 5 m long tube with superheated steam at 122° C. The two is stretched by 900% in the steaming tube, the second clamping point again being provided by a stretching septet comprising coolable rolls. Immediately thereafter the two is crimped by means of a superheated steam jet at 140° C., and relaxed on a sieve belt by means of hot air at 190° C.

The dwell time is 2.5 minutes. The residual solvent vapours which escape are recovered via an exhaust and a cooling system. The fully shrunk tow is then cut into 60 mm staple fibres, which are passed into a packing press. The acrylic fibres thus prepared in a continuous process have a final individual fibre linear density of 1.9 dtex. The fibre tenacity is 4.7 cN/dtex, and the elongation at break is 13%. The fibres are completely free of voids and have a density of 1.181 g/cm$^3$. Yarns prepared at 140 m/min from these fibres on a high-performance carding machine have a breaking length of 22.7 km, an elongation at break of 17.5% and a boil shrinkage of 2.3%.

EXAMPLE 4

755 kg of dimethylformamide (DMF) were mixed at room temperature with stirring in a vessel with 245 kg of an acrylonitrile homopolymer having a K value of 91. The suspension is dissolved, filtered and directly fed into a spinning unit which has 20 spinning cells, all three steps being carried out as described in Example 1. The viscosity of the spinning solution measured at 100° C. is 38 falling-ball seconds. The spinning solution is dry-spun from 380-hole spinning jets, hole diameter 0.2 mm, with a take-off speed of 41.6 m/min and a draw-down of 4.8. The dwell time of the filaments in the spinning cells is 6 seconds. The cell and air temperatures are equal to those of Example 1. The air rate is 45 m$^3$/h.

The spun material, which has a total linear density of 114,000 dtex and still contains a residual solvent (DMF) content of 6.7% by weight, is again wetted right at the end of the spinning cell with a warm aqueous oil-containing antistatic spin-finish at 80°–90° C. in such a way that the oil content is 0.22% by weight, the antistat content is 0.05% by weight and the moisture content is 1.7% by weight, relative to the solids content. The tow is then stretched 10-fold as in Example 1. The tow temperature is 174° C. It is then again cooled down, crimped, relaxed and cut into 60 mm staple fibres. The acrylic fibres thus prepared in a continuous process have a final fibre linear density of 1.6 dtex, a fibre tenacity of 5.2 cN/dtex and an elongation at break of 11%. The fibres are completely free of voids and have a density of 1.184 g/cm$^3$. Yarns prepared at 120 m/min from these fibres on a high-performance carding machine have a breaking length of 24.7 km, an elongation at break of 14.6% and a boil shrinkage of 3.4%.

EXAMPLE 5 (comparison)

An Example 1 spinning solution is dry-spun through 1,264-hole spinning jets, hole diameter 0.2 mm, with a take-off speed of 208.3 m/min and a draw-down of 7.2. The dwell time of the filaments in the spinning cells is 1.2 seconds. The cell temperature is 160° C., and the air temperature is 260° C. The air rate is 35 m$^3$/h for each cell.

The spun material, which has a total linear density of 312,000 dtex and still contains a residual solvent (DMF) content of 43.5%, is again immediately on leaving the spinning cells wetted with a warm aqueous oil-containing antistatic spin-finish at 80°–90° C. in such a way that the oil content of the filaments is 0.18% by weight, the antistat content is 0.04% by weight and the moisture content is 1.7% by weight, relative to the solids content. The warm tow is then passed over an inductively heated pair of rolls at 200° C. and stretched 1:5-fold, both steps being carried out as described in Example 1. The tow temperature is 179° C. The tow is tacky, and in the stretching zone there are continual jams and breaks at the rolls and the secondary roll. Neither a further increase in temperature to 240° C., giving a tow temperature measured as 204° C., nor a reduction in the degree of stretch improve the running behaviour. Only at a tow temperature below 100° C., measured with a KT 15 radiation thermometer, does the material return to 1:5 stretchability, and can be processed into fibres in the continuous manner described in Example 1. The fibres have a linear density of 4.5 dtex and combine a tenacity of only 1.3 cN/dtex with an elongation at break of 123%. Evidently the tow, which still has a high solvent content, is mainly only cold-stretched. The same results are obtained when the stretch over septet rolls with an inserted steam tube is carried out under the conditions described in Example 3.

EXAMPLE 6 (comparison)

An Example 1 spinning solution is dry-spun through 1,264-hole spinning jets as described there. Part of the spun material, which has a total linear density of 310,000 dtex and still has a residual solvent (DMF) content of 11.1% by weight, is immediately on leaving the spinning cells wetted with a warm aqueous oil-containing antistatic spin-finish at 80°–90° C. in such a way that the moisture content in the spun material is 56.4% by weight, the oil content is 0.22% by weight and the antistat content is 0.04% by weight, relative to the solids content. In the subsequent stretching step, carried out as described in Example 1, a tow temperature of only 86° C. is reached. There are continual breaks in the stretching zone, so that a continuous aftertreatment was not possible.

EXAMPLE 7 (comparison)

Some more of the spun material of Example 6 is again stretched by 500% at a roll temperature of 240° C. The tow temperature is 139° C. The uncooled tow is then directly crimped in a stuffer box, and is relaxed as in Example 1. The filaments of the tow are stuck together into strands, giving the tow a certain amount of water rigidity. Cutting the tow into staple fibre gives substantial amounts of lumps of unseparated fibre.

We claim:

1. A process for preparing filaments and fibres made of of acrylonitrile polymers which contain at least 40 percent by weight of acrylonitrile units by spinning a spinning solution of the polymer into a spinning cell, evaporating at least some of the spinning solvent in the spinning cell, spin-finishing, stretching, crimping, heat-setting and, if desired, cutting in a continuous operation, characterized in that (a) spinning solution spun has a viscosity at 100° C. of 10 to 60 falling-ball seconds and is spun through a spinning jet, (b) the evaporation of the solvent in the spinning cell is effected by blowing hot air into the spinning cell at the head thereof at a point at most 50 centimeters below the spinning jet and along or across the filaments issuing from said spinning jet, the evaporation being controlled in such a way that on leaving the spinning cell the solvent content of the filaments is at most 40% by weight, relative to to the solids content of the fibre, (c) before the stretch the filaments are treated with a spin-finish which contains a lubricant and an antistat and gives the filaments a moisture content of at most 10% by weight, relative to the solids content of the fibre, and (d) before the stretch the filaments have no contact with any other extraction liquid for the spinning solvent.

2. Process according to claim 1, characterised in that the draw-down of the process is greater than 2.

3. Process according to claim 1, characterised in that the spinning solution has a viscosity of 15–50 falling-ball seconds at 100° C., the solvent content of the filaments on leaving the spinning cell is at most 20% by weight, relative to the solids content of the fibre, and the tow temperature during stretching is 100 ° to 180° C.

4. Process according to claim 3, characterised in that the stretching ratio is 2 to 12.

5. Process according to claim 1, characterised in that the spinning solution is prepared as part of the continuous process.

6. Process according to claim 5, characterised in that the spinning solution is prepared by solution polymerisation in the spinning solvent used.

7. Process according to claim 1, characterised in that soluble dyestuffs or pigments are added to the spinning solution to produce spun-dyed filaments and fibres.

8. Process according to claim 1, characterised in that the stretch is carried out with at least 100,000 dtex tows.

9. Process according to claim 1, characterised in that crimping is effected with a superheated steam jet at at least 105° C. at stretching speeds above 300 m/min.

* * * * *